US011123613B2

(12) United States Patent
Reicher

(10) Patent No.: US 11,123,613 B2
(45) Date of Patent: Sep. 21, 2021

(54) GOLF BALL GRABBER

(71) Applicant: UpLift Sporting Goods, LLC, Rancho Santa Fe, CA (US)

(72) Inventor: Murray A. Reicher, Rancho Santa Fe, CA (US)

(73) Assignee: UPLIFT SPORTING GOODS, LLC, Rancho Santa Fe, CA (US)

( * ) Notice: Subject to any disclaimer, the term of this patent is extended or adjusted under 35 U.S.C. 154(b) by 0 days.

(21) Appl. No.: 16/897,603

(22) Filed: Jun. 10, 2020

(65) Prior Publication Data

US 2021/0031077 A1 Feb. 4, 2021

Related U.S. Application Data

(60) Provisional application No. 62/879,777, filed on Jul. 29, 2019, provisional application No. 62/956,263, filed on Jan. 1, 2020.

(51) Int. Cl.

| | |
|---|---|
| ***A63B 57/00*** | (2015.01) |
| ***A63B 47/02*** | (2006.01) |
| ***A63B 57/30*** | (2015.01) |

(52) U.S. Cl.

CPC ..... *A63B 47/02* (2013.01); *A63B 57/357* (2015.10)

(58) Field of Classification Search

CPC ..... A63B 47/02; A63B 57/357; A63B 57/40; A63B 71/023

USPC ..... 473/177

See application file for complete search history.

(56) References Cited

U.S. PATENT DOCUMENTS

| | | | | |
|---|---|---|---|---|
| 979,313 | A * | 12/1910 | King et al. | |
| 2,684,245 | A * | 7/1954 | Jacoby | A63B 57/357 473/176 |
| 3,180,644 | A * | 4/1965 | Winquist | A63B 47/02 473/177 |
| 3,790,166 | A * | 2/1974 | Hamilton | A63B 57/357 473/177 |
| 5,393,053 | A * | 2/1995 | Wiese | A63B 57/405 473/177 |
| 8,740,716 | B1 * | 6/2014 | Mallonee | A63B 57/405 473/177 |
| 2018/0207496 | A1 | 7/2018 | Zeidan | |

OTHER PUBLICATIONS

PushNPutt,Product Information, PushNPutt Golf Products; 2017-2019, downloaded from website on Sep. 9, 2020; 2 pages.

Falcon Golf Product Information; Falcon Golf; 2020, downloaded from website on Sep. 9, 2020; 1 page.

* cited by examiner

*Primary Examiner* — Nini F Legesse

(74) *Attorney, Agent, or Firm* — Knobbe, Martens, Olson & Bear LLP

(57) ABSTRACT

A golf ball remover allows easy removal of a golf ball from a golf hole while the flagstick is left in place, thereby sparing physical strain on the golfer and potential damage to the hole. The golf ball remover may user the flagstick itself as a movement guide, with a ball grabbing component that is not kept within the hole, but instead is stored above the hole on the flagstick and is pushed down into the hole when used. The golf ball remover may be attached to a retractable cord and/or other movement component to automatically lift it out of the hole.

19 Claims, 14 Drawing Sheets

GOLF BALL GRABBER

INCORPORATION BY REFERENCE TO ANY PRIORITY APPLICATIONS

This application is a non-provisional of and claims priority to U.S. Provisional Patent Application No. 62/879,777, filed on Jul. 29, 2019, entitled "GOLF BALL PLUCKER", and also is a non-provisional of and claims priority to U.S. Provisional Application No. 62/956,263, filed on Jan. 1, 2020, entitled "GOLF BALL PLUCKER CO-AXIAL FLAGSTICK". The disclosure of the foregoing application is hereby incorporated by reference in its entirety.

BACKGROUND

Field of the Invention

This application relates to improvements in golf equipment.

Description of the Related Art

The two major organizations that govern the rules of golf, The United States Golf Association (USGA) and the Royal and Ancient (R & A) introduced changes to rules of golf as of 2019. Among the rule changes provided by both organizations, there is no longer a penalty if a ball played from the putting green hits a flagstick left in the hole.

As a result, many amateur and professional golfers now choose to putt with the flagstick remaining in the hole. As a result, the speed of play may be increased as intended, but at the same time, leaving the flagstick in place leads to difficulties in manual removing the ball from the hole as a golfer must carefully place his or her fingers between the flagstick and the perimeter of the hole. This may result in added physical strain to the golfer and may also result in the golfer more frequently inadvertently damaging the hole while attempting to remove the ball.

SUMMARY

In some embodiments, a guide component is sized and configured to slide up and down a flagstick. For the purpose of this discussion, a flagstick is defined as a vertical pole or rod, which may be solid or hollow, which may or may not have a constant diameter, which may be composed of various materials (such as steel, aluminum, fiberglass), and is placed in a golf hole for the purpose of marking the position of the hole. A guide component may be a hollow cylinder or a fraction of a hollow cylinder, such as a half cylinder or some other fraction of cylinder with a longitudinal aperture size to fit around a golf flagstick. In other embodiments, a guide component could be composed of a flat object, such as in conjunction with an attachment mechanism that maintains the flat object in immediate proximity to the flagstick and allows it to glide up and down along the flagstick. In some embodiments, a cylindrical guide component could be adjustable in radius to conform to the diameter of the flagstick. A guide component may be attached to the flagstick in a variety of ways. For example, it may be tied to the flagstick, snap on to the flagstick or held in place by adjustable or snap-on rings or partial rings. The inherent partial cylindrical shape of the guide component may conform to the shape of the flagstick so that it snaps on to the flagstick to remain in place. The cylindrical guide component could also be composed of two or more components that are assembled together with screws, rivets, or latches in order to be placed on the flagstick without needing to slide the guide cylinder on from the top or bottom of the flagstick where ferrules may pose an obstruction. In some embodiments, a guide component may hollow or solid and include a component that resides within a hollow flagstick.

One advantage of the guide component is that it glides along the flagstick and thereby prevents or reduces the probability of the ball-grabbing component or ball from striking the perimeter of the hole as the device is introduced or as the ball is being removed from the hole. The guide component could be made from plastic, fiberglass, metal, wood, wire, rubber and/or other such material. It could be manufactured from a mold, bending a wire, 3-D printing, or other methods. It could be built into the flagstick itself.

The guide component could be attached to other components, such as a ball-grabbing component, via glue, screws, inherent tight fit, or other such manner. Alternatively, the guide component and other components could be one continuous device. The guide component and/or ball-grabbing component could be labeled, marked, colored, or positioned on the flagstick in such a way as to indicate the relative position of the hole on the green, indicating for example, whether the hole is toward the front, middle, or back of the green. Thus, the guide component may be used as an indicator of location of the flag, as permitted under Part 8 of the USGA Committee Equipment Requirements.

In some embodiments, the ball removers discussed herein may include a movement component (also referred to as a "retraction device," such as a spring, elastic material, or retractable cord or keychain device, for example. The movement component may be attached to the flagstick and configured to automatically retract the guide and/or ball-grabbing component upward to a pre-fixed location on the flagstick. If a spring device is employed, it may be a compression spring attached to near or at the upper end of the guide and the upper end of the flagstick, such that it becomes progressively compressed as the ball grabber and guide are pushed down into the golf hole, with the spring then causing the ball remover and guide to retract back to their initial position. Alternatively, it may be a compression spring device running co-axially over the flagstick, interposed between the flagstick and an outer co-axial guide tube. In this example, the spring is constrained from sliding down the flagstick, for example, at a location 30" above the putting surface by a bushing, shaft collar, glue, or retaining pin. In this example, the spring is also constrained at or near the top of the guide. As a result, when the guide tube and ball grabber are pushed down into the hole, the spring is compressed, subsequently causing the guide tube and ball-grabber to automatically rise up the flagstick to the initial position. The thickness of the spring, material used to manufacture the spring, number and spacing of the spring coils, may be designed to optimize the compression force needed to push the ball-grabber into the hole and then automatically lift the ball, ball-grabber, and guide to the proper position. Instead of (or in addition to) a spring, an elastic cord may be used, such as an elastic cord comprising a linear strip of nylon, Kevlar, rubber or other such material. It could be linear, spring shaped, or shaped otherwise. The retraction device advantageously retracts the guide and grabbing components upward out of the hole to the intended stored position of those components. Combinations of springs and elastic cords may be used. For example, two springs may be used that introduce opposing forces in order to dampen the speed of the retraction of the device.

Embodiments of a ball remover device may include one or more of:

- a spring-loaded piston like flagstick, wherein the ball grabbing component is attached to an external guide component, optionally doubles as a hole position indicator, and is pushed down into the hole to extract the golf ball, then the external guide component and attached grabbing component (and position indicator) automatically return to their initial position.
- a co-axial flagstick wherein an external coaxial hollow flagstick extends down to the base of the golf hole and contains one or more vertical slits so that an inner guide component can be controlled by the user to slide a ball-elevating disk (or grabbing component) up and down, thus reducing shock-absorbing effects that may be occur when a golf ball strikes an external guide component.
- a co-axial flagstick in which an inner guide component is magnetically coupled to a ball elevating device and/or an external lifting collar or handle.

The various embodiments disclosed herein may provide one or more of the following advantages:

- Allows removal of a golf ball from the hole without the golfer inadvertently damaging the hole's perimeter.
- Allows the golf ball to be lifted well above the hole so that the golfer does not need to bend over or bend over as far to retrieve the ball.
- Automatically returns the ball grabbing component to well above the hole so that it is not inadvertently left inside the hole or in proximity to the putting surface in a manner that would create a rule violation or inconvenience for the golfer.
- Conforms to the rules of golf because the ball remover device may also function as a hole position indicator, and thus may be "reasonable sized" yet greater than two inches in diameter.
- Avoids a shock-absorbing tube or wire external to the flagstick at or near the putting surface
- Avoids a disk-like device fixed to the flagstick near the bottom of the hole so does not alter what happens when a ball bounces in a hole.
- Avoids any external guide tube or device that rests along or surrounds the flagstick at or near the level of the putting surface, thereby reducing any shock-absorbing or deflecting effect that might alter what normally happens when a ball strikes the flagstick.
- A further advantage is that if a golfer chooses not to use the ball-grabbing and guide device, whether putting with the flagstick in or out, the experience is unaltered from the experience with pre-existing flagsticks. In other words, it does not disrupt the experience of the golfer that chooses not to take advantage of its benefits.
- Alternative ball-lifting flagstick devices that rely on a disk or disk-like device that is attached to the bottom of the flagstick or to a guide such that the disk rests near the bottom of the hole present disadvantages relative to the ball grabber embodiments discussed herein. For example, when a disk is at the bottom of the hole, each time the flagstick is removed and replaced there is a risk of hole damage, with the risk increased as the size of the disk is increased.

BRIEF DESCRIPTION OF THE DRAWINGS

Items are generally consistently numbered so that an item labeled "1", for example, refers to the same component in each of the figures. The figures are not intended to be precisely drawn to scale. The numbered items in the figures may be referred to as components and/or more descriptive terms, where the like reference numbers refer to the same or similar component throughout the figures.

In FIGS. 1A-1C, the lower margin of the spring is shown attached or constrained by the top of the inner rod, but in other embodiments the lower end of the spring that is wrapped coaxially around the flagstick may be constrained by a shaft collar, bushing, tape, glue, or a horizontal retaining pin drilled into the rod. The fixation of the spring to the top of the coaxial tube is not shown in FIGS. 1A-1C, but various embodiments are possible for this attachment, including a bushing or cap attached to the top of the tube via tape, glue, screw, a retaining pin, or other such method.

DETAILED DESCRIPTION

Conventional flagsticks used on golf courses are generally over seven feet tall and more difficult to lift from or insert into a hole vertically as compared to shorter practice green flagsticks. As a result, any disk or cup-like device attached to or near the bottom of the flagstick may in fact inadvertently bang into the side of the hole and damage the margin of the hole when the flagstick is removed or inserted.

Disclosed herein are embodiments of an improved method and apparatus for removing a golf ball from the hole while leaving the flagstick in place in the hole. The embodiments disclosed herein may reduce or eliminate the chance of the ball or device striking the margin of the hole (e.g., either the dirt around the edges of the hole and/or a cup that is placed in the hold in the ground) when the ball is removed.

Example Ball Remover

Figure 1A:
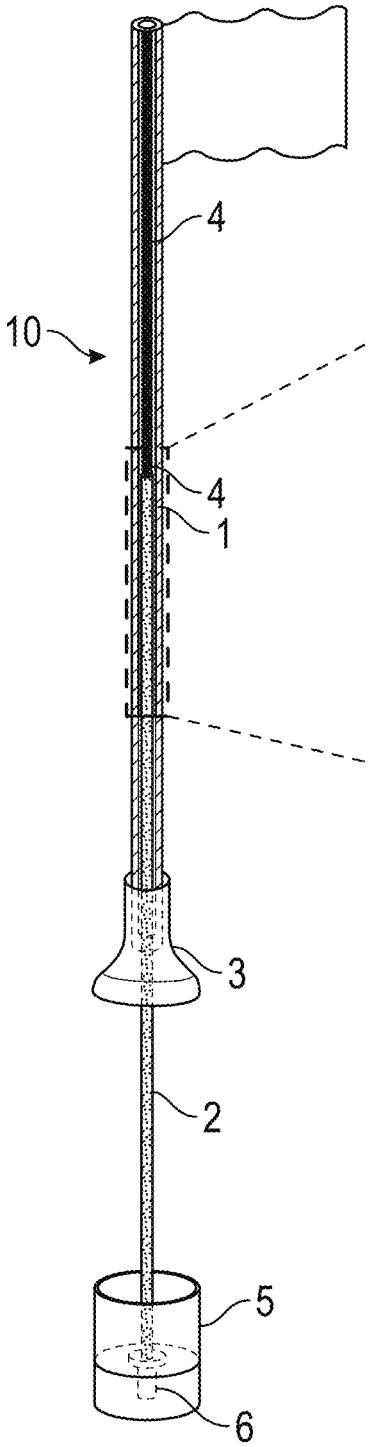
FIGS. 1A-1C illustrate an example ball remover as may be implemented in conjunction with a flagstick and a golf hole. In the embodiment of FIGS. 1A-1C, a compression spring is illustrated laying above the central flagstick rod and surrounded by the coaxial guide tube. However, in other embodiments, the coaxial spring wraps coaxially around the flagstick down to approximately the level of the ball removing device. In the embodiment shown in FIGS. 1A-1C, the external guide tube extends to the top of the flagstick, but in other embodiments, the guide tube does not extend to the top of the flagstick.
Figure 1B:
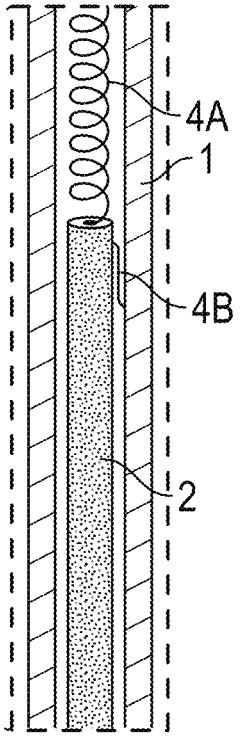
Figure 1C:
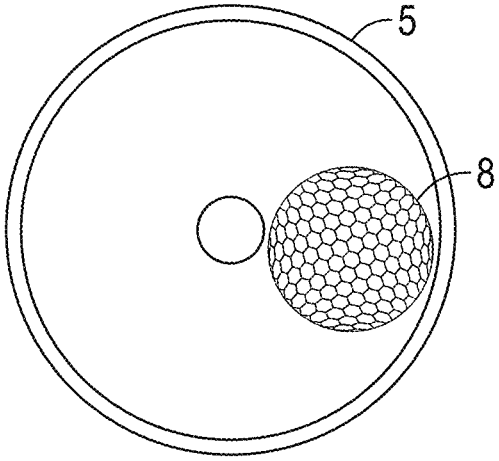

With reference to FIGS. 1A-1C, a guide component 1 comprises an external coaxial hollow tube that conforms to the USGA Rules of Golf regarding diameter and shock absorbing qualities. In some embodiments, this guide component 1 is made of fiberglass (or plastic, metal, or other durable material), has a constant outer diameter of about 0.75 inches and an inner diameter of about 0.55 inches. In some embodiments, the guide component 1 need not have a constant outer diameter and may be wider, e.g., up to about 2" in outer diameter near it's midportion, while smoothly tapering to about 0.75 inches or less at its upper and/or lower regions, thus simulating the shape that the golf community commonly calls a "tournament" flagstick. The inner diameter of the coaxial hollow tube may also be larger to allow space for a coaxial spring that wraps around the inner flagstick rod to pass freely between the rod and tube. As previously noted, the guide component may not be solid, but may instead be composed of assembled components, such as two half-cylinders that are fixed together or even a series of stacked rings of variable diameters.

In some embodiments, the guide component 1 is attached to the golf flagstick 2 or flag-like device near or at the top of flagstick 2. When used to retrieve a golf ball 8 from the hole (or "cup") 5 (see FIG. 1C, which is a top view of a golf hole 5 with a golf ball 8 therein), the guide component 1 is slid down over flagstick 2, pushing a grabbing component 3 towards and at least partially into the hole 5. In the example of FIGS. 1A-1C, the guide component 1 is returned to its position as a result of a movement component 4, such as a spring (e.g., spring 4A) and/or spring-like device (e.g., elastic material 4B) that is attached to the guide component 1. The elastic material 4*b* may be attached to the inner rod and outer tube in various positions and manners in order to achieve the desired result: to enable the user to push the ball retriever into the hole and have it return to its initial position.

Depending on the embodiment, movement component 4 may have various components and configurations, such as one or more of a spring or elastic material that stores and releases elastic potential energy, and/or any other mechanical or electrical source of a physical force. In embodiments with a spring, the spring may be exchanged from springs of various lengths or the cap component at the top of the flagstick may be exchanged for stop components of various lengths. As a result, golf maintenance personnel may easily change the length of the flagstick and/or the relative position of the ball-grabber/position indicator as the hole position is changes on various days.

In some embodiments, the movement component 4 comprises an elastic-functioning attachment between guide component 1 and flagstick 2 so that when guide component 1 is pushed down, it automatically returns to its initial position relative to the flagstick 2. The movement component 4 may be attached to one or more of an upper portion of the inner rod of the flagstick 2 and/or an lower portion of the guide component 1. Thus, when the guide component 1 is pushed down, the elastic is distracted. In some embodiments, there is a second more superficial guide component that prevents the elastic from coming into view as the first guide component is pushed down. In some embodiments, the movement component 4 is not firmly attached to the guide component 1, but is instead held in place by a cap or other stopping device at or near the top of the guide component 1.

In the example of FIGS. 1A-1C, the flagstick 2 is a rod that may be solid or hollow and is designed to conform to the USGA Rules of Golf. For example, the flagstick 2 may be no greater than 0.75 inches in constant diameter from three inches above to three inches below the putting surface. In some embodiments, the flagstick 2 is a solid fiberglass rod measuring about 0.5 inches in outer diameter and attached to a ferrule 6 at its distal end. In another embodiment, the flagstick is about 0.375 inches in diameter. The ferrule 6 is designed to fit into a hole insert at the bottom of the hole insert 5.

In the example of FIGS. 1A-1C, the ball grabbing component 3 is attached to the distal end of guide component 1. As discussed further below, the ball grabbing component 3 may temporarily grab, adhere, lift, or otherwise attach to the golf ball. For example, the grabbing component 3 may grab the golf ball by pinching it along the lateral margins of the ball, wherein lateral margin refers to the sides of the golf ball 8 that are not directly adjacent to the flagstick 2 or the inner perimeter of the hole 5. In some embodiments, the ball-grabbing component may slide down past the equator of the golf ball, and being composed of a somewhat flexible material, spread to accommodate the golf ball equator, then spring back to a diameter less than the golf ball equator. As a result, the golf ball may come to rest on top of a portion of the ball grabbing component, so that when the ball-grabber is raised back up to its initial position, the golfer can simply lift the ball from the ball-grabber instead of forcing the ball from an actively pinched position. In some embodiments, a ball grabber component 3 includes a cover, such as a bell-shaped (or similar) covering, that covers other portions of the ball grabber component 3. In some embodiments, this bell-shaped covering is displaced upward relative to ball grabbing component 3 by the grabbed golf ball and returns to its initial position as a result of a spring mechanism or gravity after the extracted golf ball is removed. Whether or not there is a bell-shaped covering, some other circumferential covering, or no covering, the ball remover 10 itself is designed to optionally double as a position indicator by virtue of an easily recognized characteristic, such as its color or location relative to the entire flagstick.

In some embodiments, the grabbing component 3 is attached to the external coaxial tube guide component 1 via a snap-on or screw-on mechanism. The grabbing component 3 may also be composed of multiple parts that snap together or screw together so that it can be easily removed and replaced from the guide component 1. This may also facilitate the golf maintenance staff making changes to the entire ball remover 10 or portion thereof to change the characteristics to indicate the hole position. In some embodiments, the movement component 4 may be adjustable, such as, for example, adjusting a spring stop position or exchanging springs of various lengths, in order to adjust the total length of the flagstick 2 or adjust the relative position of the grabbing component 3 at rest, therefore also providing means of using the ball-grabber 3 as a hole position indicator.

Figure 2:
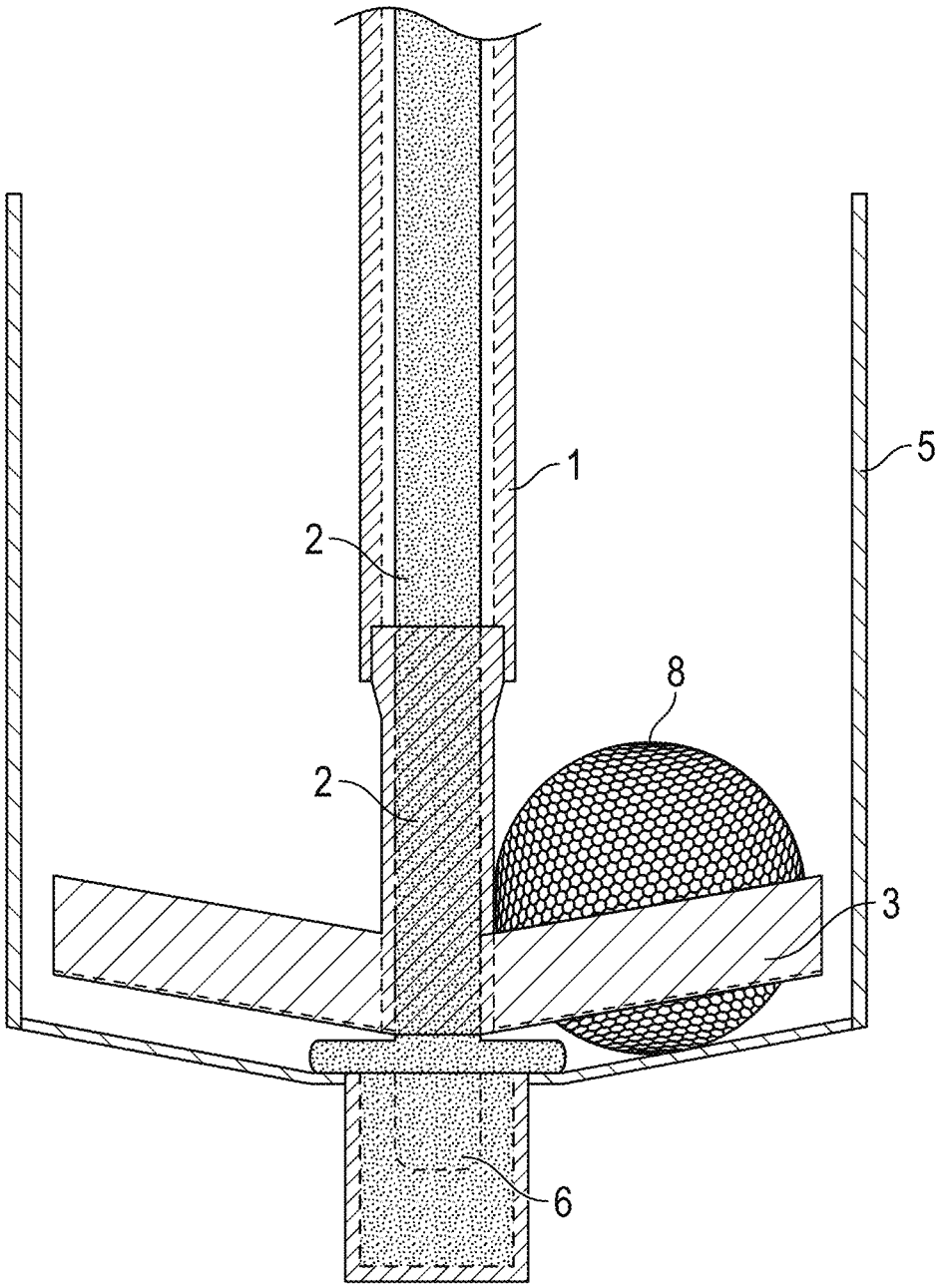
FIG. 2 is a close-up view of a portion of a grabbing component positioned to lift a golf ball out of a golf hole. Note that when pushed down, the grabbing component extends below the equator of the ball. The equator may or may not be parallel to a plane level to the earth. By using a ball grabbing device that captures the ball by extending below a ball equator that is angled, the total perimeter of the grabbing device may be reduced, thus enabling use of a ball-grabbing device with a smaller external perimeter. This is advantageous because it provides more clearance between the perimeter of the ball grabbing device and the inner perimeter of the hole insert.

FIG. 2 is a close-up view of a portion of a grabbing component 3 positioned to lift a golf ball 8 out of a golf hole 5. In this example, the grabbing component 3 is attached to a distal end of the guide component 1 so that when lowered into the golf hole 5, portions of the grabbing component 3 are positioned below the golf ball 8 and configured to lift the golf ball 8 out of the golf hole 5 for retrieval by the golfer. Once the golf ball 8 has been removed from the golf hole 5, the ball grabber (e.g., including the guide component 1 and grabbing component 3, return to a position above the golf hole 5 where they are out of the way of the golf hole 5. As discussed elsewhere, the ball grabber may be return to a resting position on the flagstick 2 using various movement components 4. Whereas in FIG. 2, it appears that the guide tube surrounds the flagstick at the level of the ball grabber, in various embodiments, that guide component or ball grabber may not completely surround the flagstick, thus leaving more space between the flagstick and the perimeter of the hole.

FIGS. 3-7 provides example embodiments and configurations of grabbing components 3. Depending on the implementation, any of these grabbing components 3 and/or combinations or alterations of the example grabbing components 3 may be used.

Figure 3A:
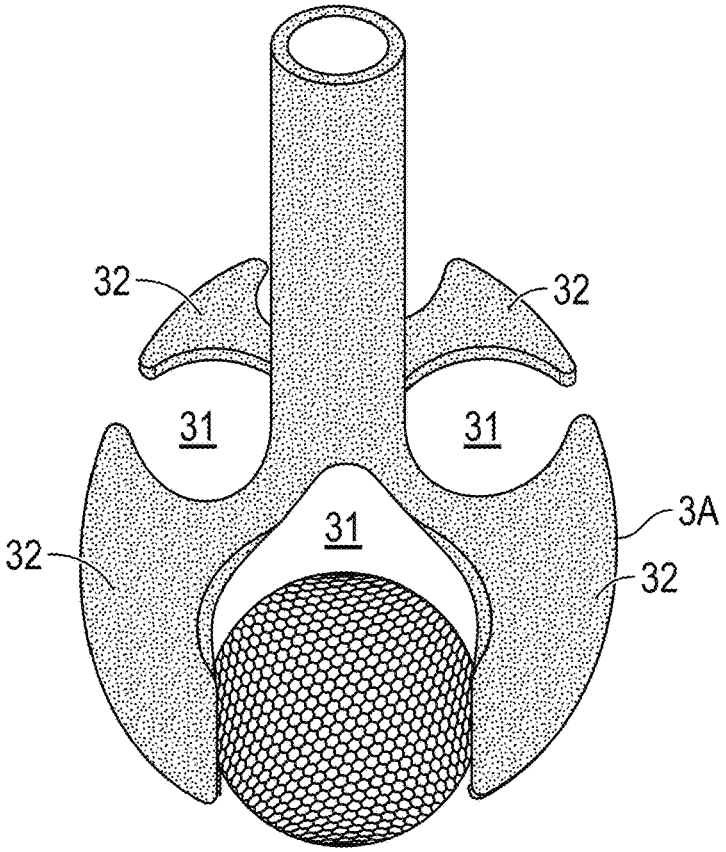
FIG. 3A is a perspective view of a grabbing component, having multiple openings each sized to engage a golf ball when pressed down around the golf ball.
Figure 3B:
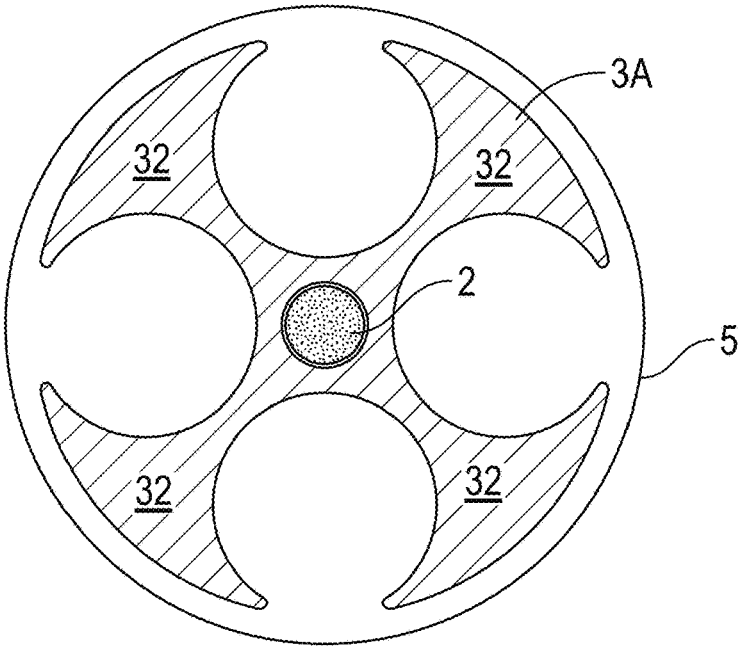
FIG. 3B is a cross-sectional view of the grabbing component of FIG. 3A.

FIG. 3A is a perspective view of a grabbing component 3A, having multiple openings 31 each sized to allow a golf ball to be engaged by flexible members 32 when pressed down around the golf ball. FIG. 3B is a cross-sectional view of the grabbing component 3A of FIG. 3A. In this embodiment, the grabbing component 3A includes flexible members 32 that flex as they are pushed against the golf ball 8 and grab the ball between adjacent flexible members 32 when they are positioned around a central (wider) portion of the golf ball 8.

Figure 4A:
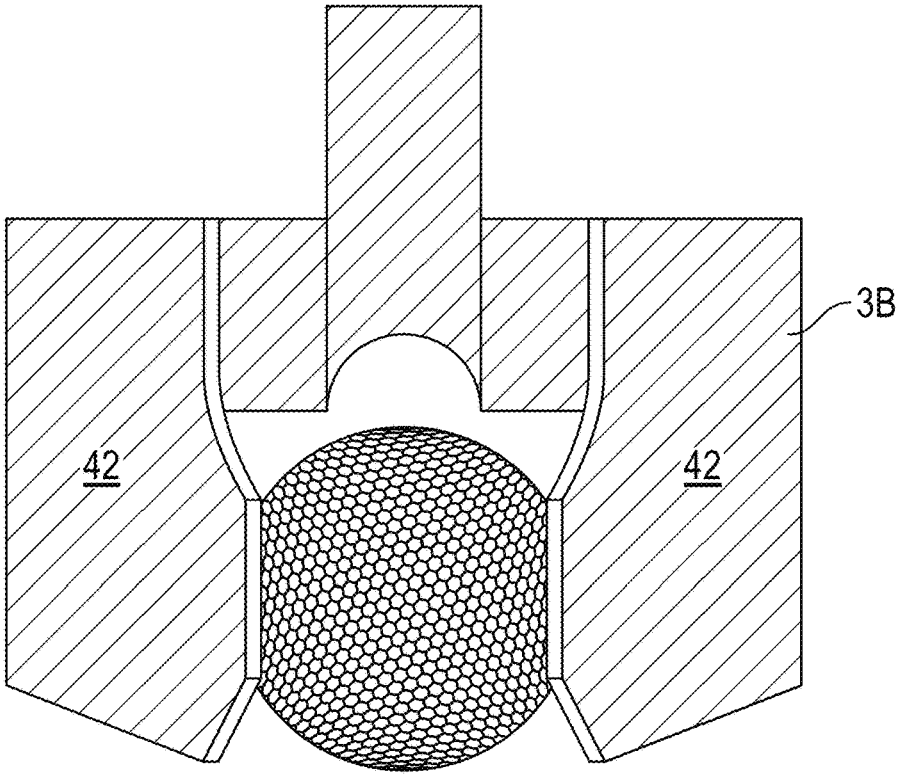
FIG. 4A is a side view and FIG. 4B is a cross-sectional view of a grabbing component that includes two flexible members arranged to form two openings sized to engage the golf ball between the flexible members.
Figure 4B:
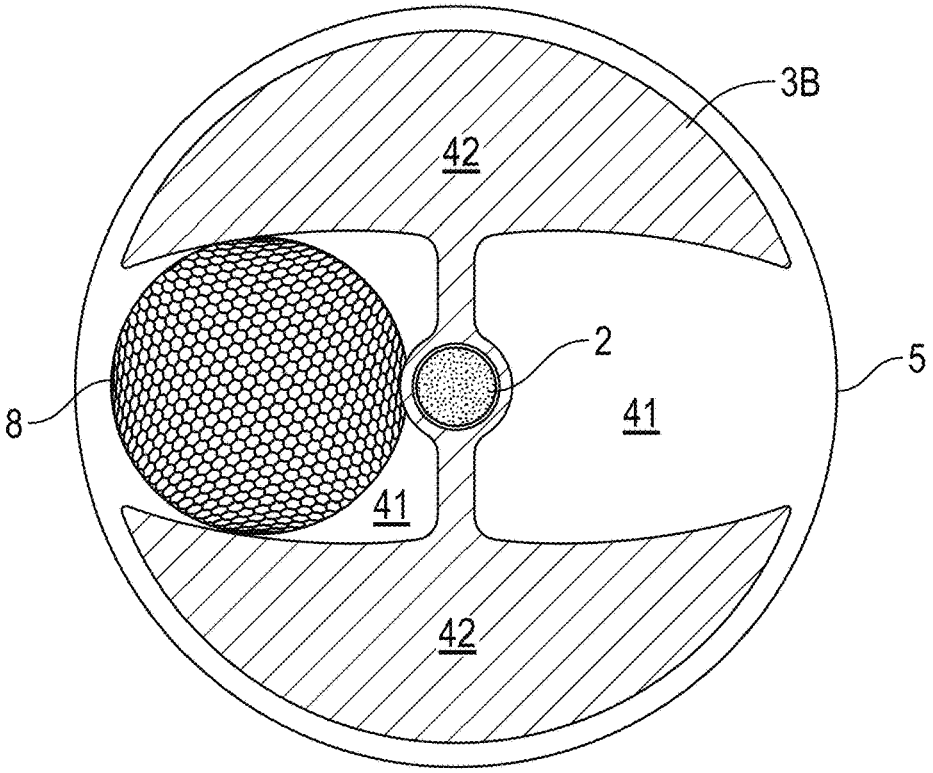

FIG. 4A is a side view and FIG. 4B is a cross-sectional view of a grabbing component 3B that includes two flexible members 42 arranged to form two openings 41 sized to engage the golf ball 8 between the flexible members 42. Note that at the level of the ball, the ball-grabber does not have a component interposed between the ball and the flagstick. Instead, components 42 are connected via a bridge or bar that is above the level of the ball. Although not pictured, in FIG. 4A and FIG. 4B, in other embodiments, the space between components 42 is slightly greater than the diameter of the golf ball, but there are linear bulges or ridges at or near the bottom and peripheral edges of components 42 that are closer together than the diameter of the golf ball. These somewhat flexible ridges are pushed down below the equator of the golf ball so that the ball comes to rest on top of them.

Figure 4C:
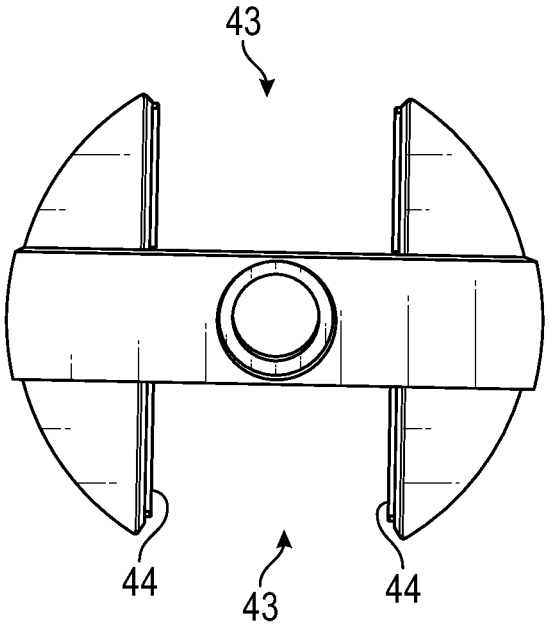
FIGS. 4C is a top view and 4D is a perspective view of another example grabbing component.
Figure 4D:
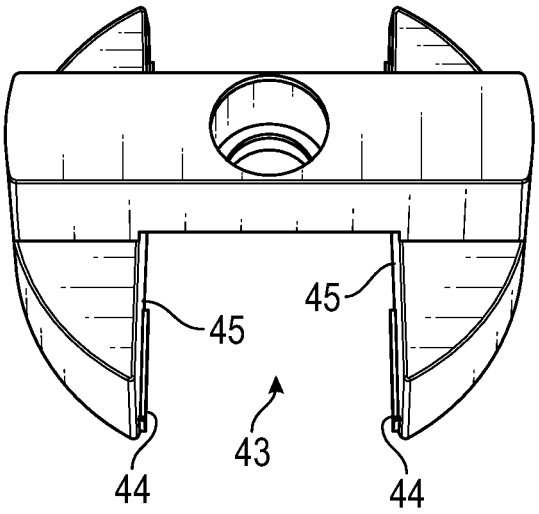
FIG. 4E is a perspective view.
FIG. 4F is a top view.
FIG. 4G is a side perspective view of another example grabbing component.

FIG. 4C is a top view and FIG. 4D is a perspective view of another example grabbing component. In this example embodiment, openings 43 are sized to allow a golf ball to fit between sides 45, while ledges 44 are snapped below an equator of a golf ball such that the ledges 44 are positioned to support the golf ball as the guide component is lifted out of the hole.

Figure 4G:
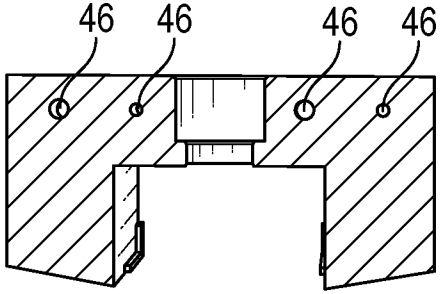
Figure 4F:
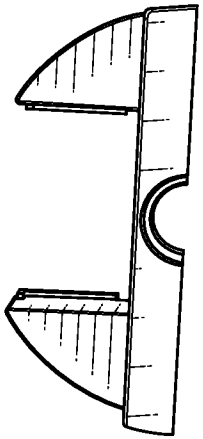
Figure 4E:
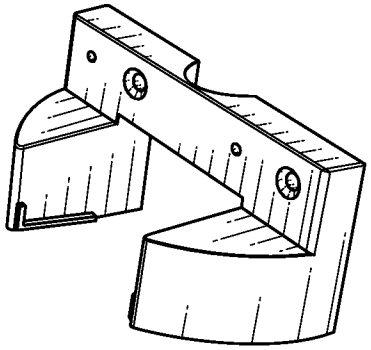
Figure 5A:
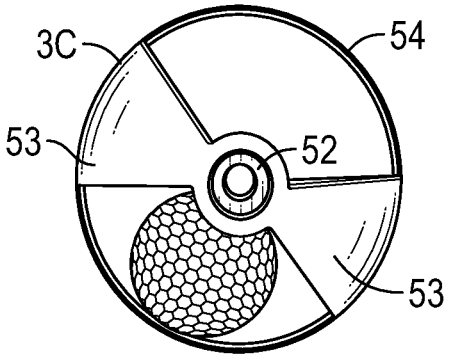
FIGS. 5A-5F are various views of another example grabbing component.
Figure 5B:
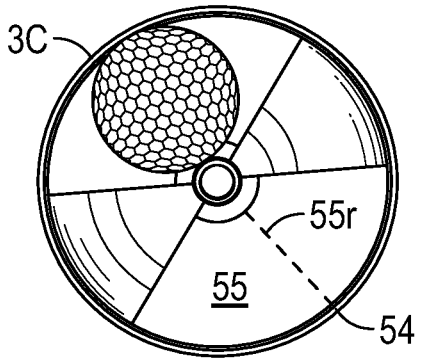
Figure 5C:
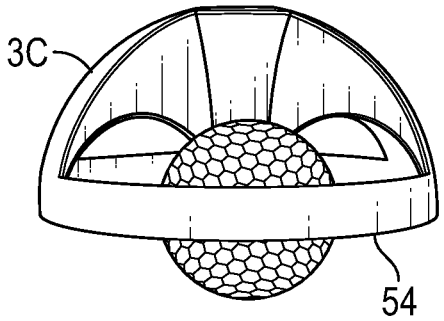
Figure 5D:
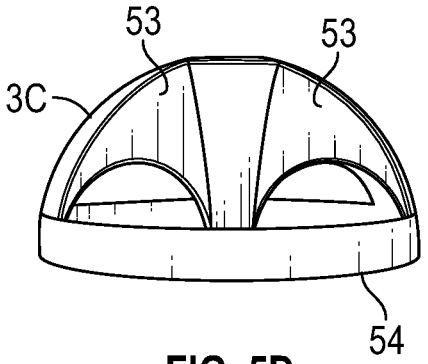
Figure 5E:
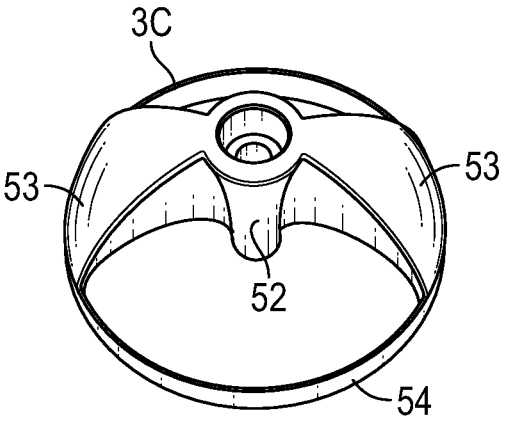
Figure 5F:
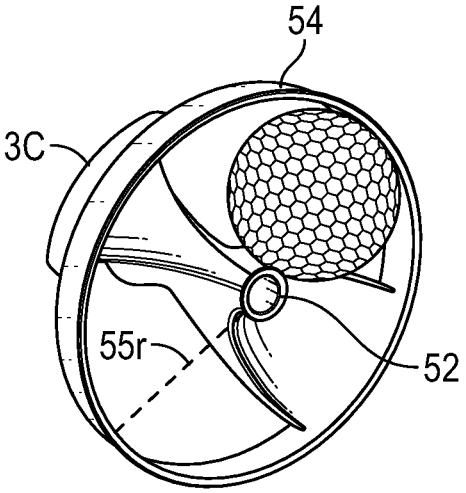
Figure 6A:
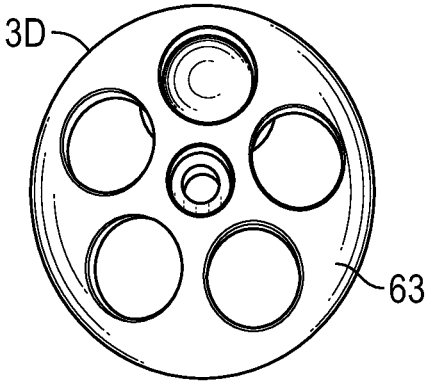
FIGS. 6A-6F are various views of another example grabbing component.
Figure 6B:
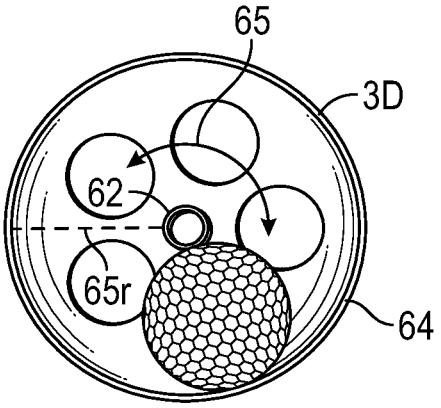
Figure 6C:
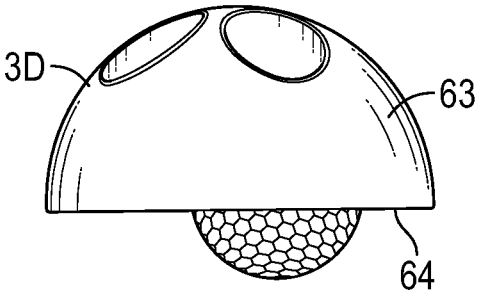
Figure 6D:
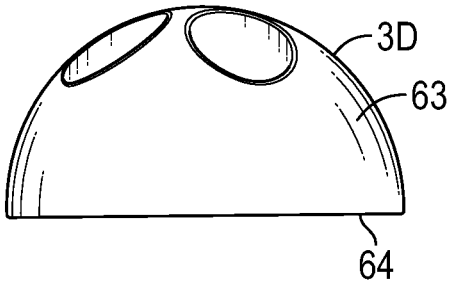
Figure 6E:
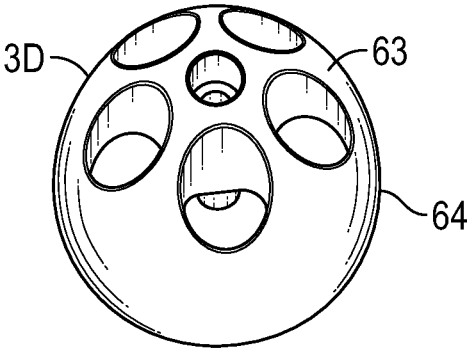
Figure 6F:
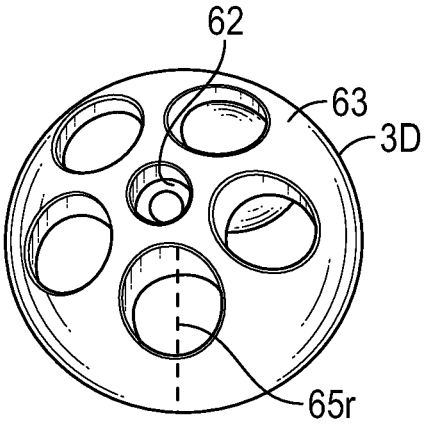

FIG. 4E is a perspective view, FIG. 4F is a top view, and FIG. 4G is a side perspective view of another example grabbing component. In this example, a guide component installed on a flagstick would include two of the grabbing components illustrated in FIGS. 4E-4G, which are generally half-cylinder structures that may be fixed together about the guide component. In this example, the ball supporting mechanism is similar to discussed with reference to FIGS. 4C and 4D, with the addition of attachment holes 46 that allow attachment of the two half-cylinder structures about a guide component, such as using a metal or plastic nut and bolt or woodscrew. In other embodiments, other attachment mechanisms may be employed, such as a snap attachment (e.g., a protruding mail attachment on one of the structures and an opposing female portion on the other structure), Velcro, an adhesive, and/or any other attachment mechanism. A two-part ball grabbing component, such as is illustrated in the examples of FIGS. 4E-4G, may be advantageous because it can be easily replaced if and when needed without disassembly of other components.

FIGS. 5A-5F are various views of a grabbing component 3C. In this embodiment, the grabbing component 3C includes an inner cylinder 52 sized to fit around a flagstick 2 while remaining moveable along a length of the flagstick 2. In this example, two support structures 53 extend from the inner cylinder 52 to support an outer cylinder 54. Advantageously, a distance between the outer cylinder 54 has a diameter that is less than an inner diameter of the golf hole 5 so that the golf hole 5 is not damaged as the grabbing component 3C is lowered into and raised out of the golf hole 5. A gap 55 with a width or radial distance 55*r* is formed between the inner cylinder 52 and the outer cylinder 54. In this example, the width 55*r* is consistent around a circumference of the inner cylinder 52. The gap width 55*r* is slightly less than the width of the golf ball 8. For example, the gap width 55*r* may be from 0.5 mm to 2 mm or more smaller than a golf ball width. Thus, when the grabbing component 3C is moved into the golf hole 5, the outer cylinder 54 may slightly flex so that the golf ball 8 enters between the inner cylinder 52 and outer cylinder 54, grabbing the golf ball 8 therebetween. When the grabbing component 3C is then raised out of the golf hole 5, the golf ball 8 is lifted out of the golf hole 5 with it. In other embodiments, a grabbing component 3 may include fewer or additional support members 53, such as one, three, or four support members. Of importance, component 54 and component 52 may not extend to the same level. For example, component 52 may extend more inferiorly that the lower margin of component 54, so that 55*r* is angled and the equator of the ball that is bypassed is not parallel to the flat earth surface. As a result of the 55*r* being angled upward from its center to peripheral margin, the circumference of 54 can be reduced while still capturing the golf ball. This example embodiment may provide more clearance between the ball-grabber and the hole.

FIGS. 6A-6F are various views of a grabbing component 3D. In this embodiment, the grabbing component 3D includes an inner cylinder 62 sized to fit around a flagstick 2 while remaining moveable along a length of the flagstick 2. In this example, a semi-hemispherical support structure 63 extends outward from a proximal (top) portion of the inner cylinder outward to form an outer cylinder 64. The outer cylinder 64 may be formed of the same materials as other portions of the grabbing component 3D and/or may include another material that is attached to the support structure 63. Advantageously, the outer cylinder 64 has a diameter that is less than an inner diameter of the golf hole 5 so that the golf hole 5 is not damaged as the grabbing component 3D is lowered into and raised out of the golf hole 5. A gap 65 with a width or radial distance 65*r* is formed between the inner cylinder 62 and the outer cylinder 64. In this example, the width 65*r* is consistent around a circumference of the inner cylinder 62. In other embodiments, the width 65*r* may be interrupt by other support structures, such as to better maintain position of the outer cylinder 64 and maintain grip on the golf ball 8 between the inner cylinder 62 and outer cylinder 64. In the example of FIG. 6, the gap width 65*r* is slightly less than the width of the golf ball 8. For example, the gap width 65*r* may be from 0.5 mm to 2 mm or more smaller than a golf ball width. Thus, when the grabbing component 3D is moved into the golf hole 5, the outer cylinder 54 may slightly flex so that the golf ball 8 enters between the inner cylinder 52 and outer cylinder 54, grabbing the golf ball 8 therebetween. As discussed previously, 65*r* may be angled, thus enabling 64 to have a smaller circumference.

Figure 7:
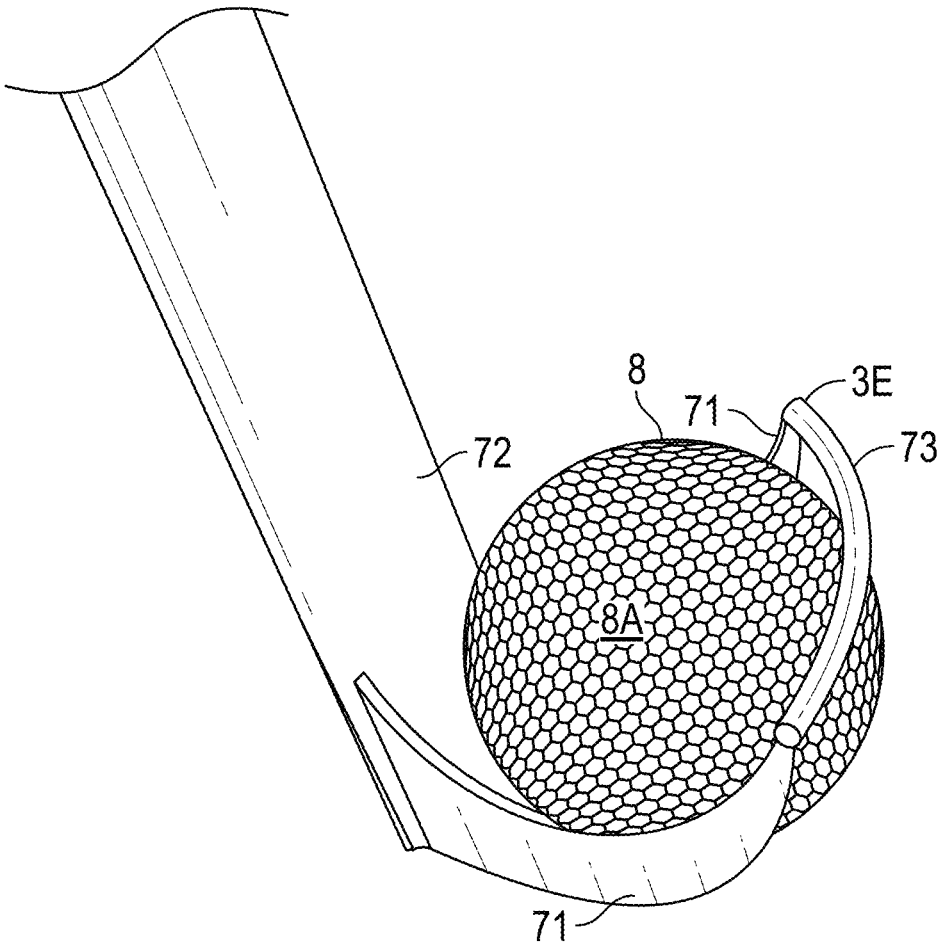
FIG. 7 is a perspective view of another example grabbing component.

FIG. 7 is a perspective view of a grabbing component 3E. In this embodiment, the grabbing component 3E includes two radially extending members 71 extending from a central cylinder 72 that are joined by a connecting member 73. One or more of the radial and connecting members 71, 73 are flexible enough to allow a central (wider) portion 8A of the golf ball 8 to pass above at least a portion of the radial members 71 so that when the grabbing component 3E is lifted upward the golf ball 8 is lifted by the radial members 71 and the connecting member 73 maintains the golf ball 8's position against the central cylinder 72 until the golf ball 8 is lifted from the grabbing component 3E by the golfer. Such a design may be used for a hand-held ball-grabber wherein the golfer manually slides the guide along the flagstick to avoid contacting the margin of the hole. This may also offer a more hygienic means of removing a golf ball from a hole.

Figure 8A:
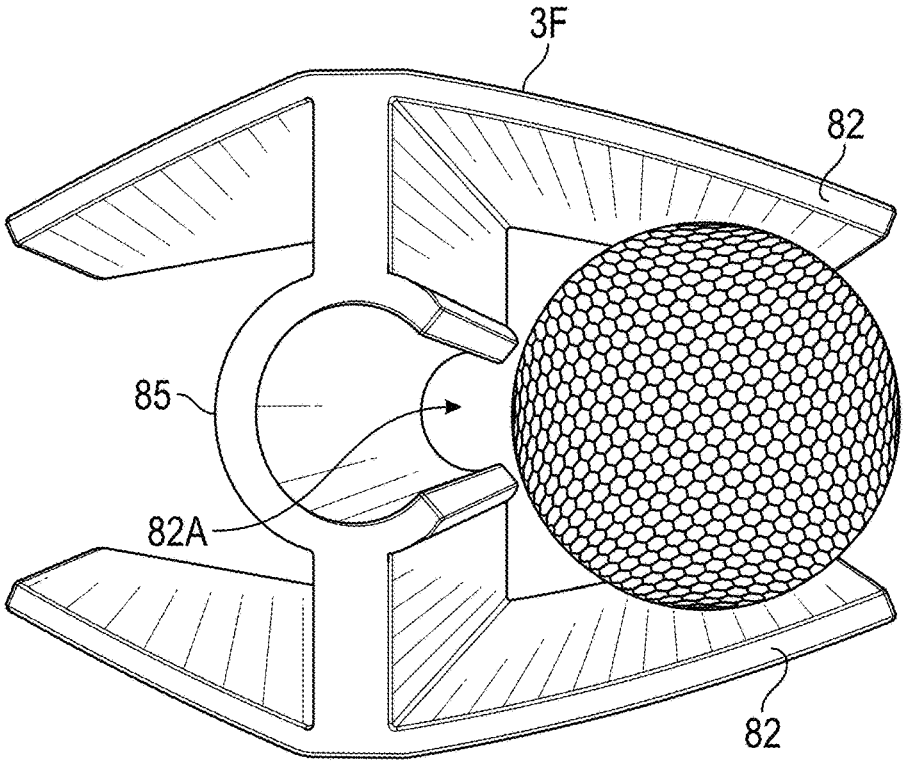
FIG. 8A is a top view and FIG. 8B is a cut-away perspective view of a portion of another example grabbing component.
Figure 8B:
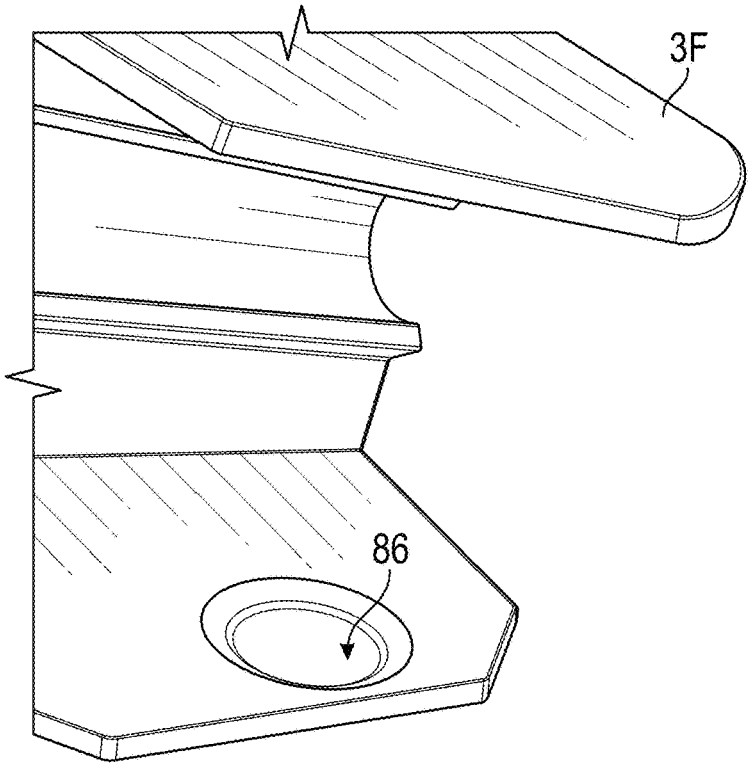

FIG. 8A is a top view and FIG. 8B is a cut-away perspective view of a portion of a grabbing component 3F. In this example, the central cylinder 85 is shown with a cut-away portion 82A sized to allow the movement component 4F to snap onto a flagstick 2. Any of the other grabbing component 3*s* may similarly include a feature, such as the cut-away portion 82A, allowing the grabbing component 3 to easily, and removably, be attached to the flagstick 2. Members 82 extend from the central cylinder 85 and at least one of the members 82 includes a detent 86 (or, more generally, a depression in the ball-facing part of the member 82 that helps hold the golf ball 8 in place) position to accept a central portion of the golf ball 8 and more securely grip the golf ball 8 between the members 82. In some embodiments, the grabbing component 3F does not include any detents 86. Any of the other grabbing component 3*s* discussed herein may include one or more detents similar to detent 86 to further aid in gripping the golf ball 8.

Figure 9A:
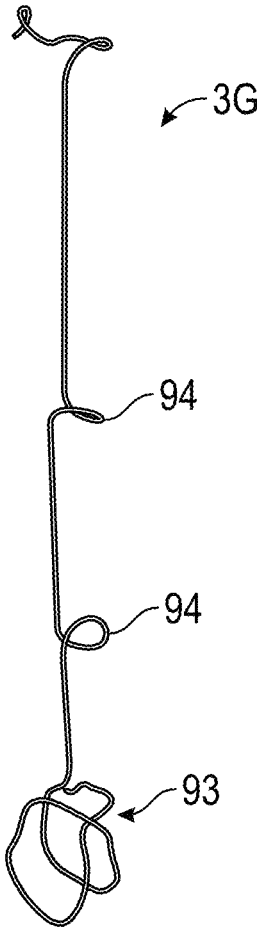
FIGS. 9A, 9B, and 9C illustrate additional example grabbing components.
Figure 9B:
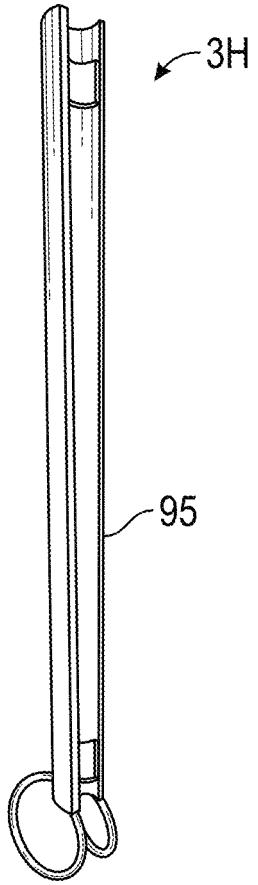
Figure 9C:
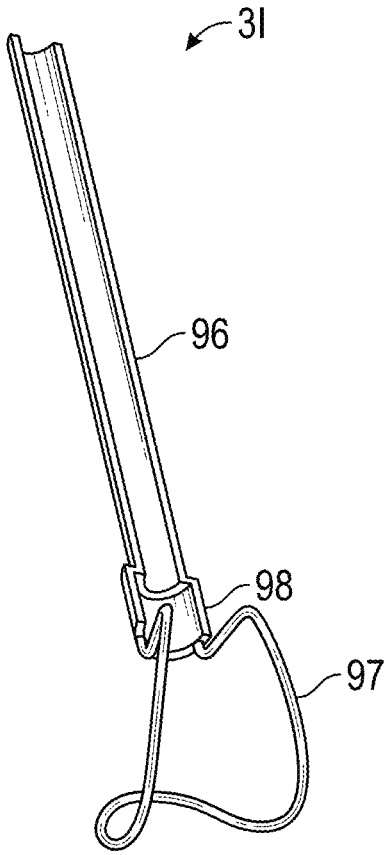

FIGS. 9A, 9B, and 9C illustrate example grabbing component 3G, 3H, and 3I. The example grabbing component 3G of FIG. 9A may be formed of a wire that includes one or more partial loops 94 sized to engage about an outer circumference of flagstick 2. The grabbing component 3G is further formed so that a portion 93 flexes about a golf ball 8 and then closes below the golf ball 8 so that it may be lifted from the golf hole 5. The example grabbing component 3H of FIG. 9B includes a semi hemispherical cylinder 95 sized to fit about a flagstick 2 so that the grabbing component 3H can be maintained in position against the flagstick 2 while being lowered into and lifted out of a golf hole 5. The example of FIG. 9C includes an attachment mechanism shaped similar to shown in FIG. 7. In some embodiments, the grabbing component may be made of a loop of wire that, when pressed down onto a golf ball 8, grabs the ball from its lateral sides. In this embodiment, the wire loop may be made of 12-gauge stainless steel wire and is shaped such that when it is pushed down, the margins along the lateral sides of the ball are minimally displaced by the ball. As a result, after the wires on the lateral sides of the ball pass down beyond the ball's equator, the wire springs back so that the ball rests in the loop and can be easily lifted out of the hole without the device or ball touching the hole's perimeter.

The example grabbing component 3I of FIG. 9C includes an attachment member 97 attached to a central cylinder 96 via a hinging component 98. In this embodiment, the member 97 may rotates outward via the hinging component to expose a larger opening for the golf ball 8 to pass through, and then rotate inward to be positioned below the golf ball 8 where the grabbing component 3I can be lifted to remove the golf ball 8 from the golf hole 5. The embodiments of FIG. 9 may be especially useful in implementations where the ball remover 10 is carried by the golfer and attached to the flagstick 2 as needed. For example, these grabbing components may not include portions meant for permanent attachment to the flagstick 2, but may be carried by the golfer and manually slid along the flagstick 2 as needed.

Figure 10:
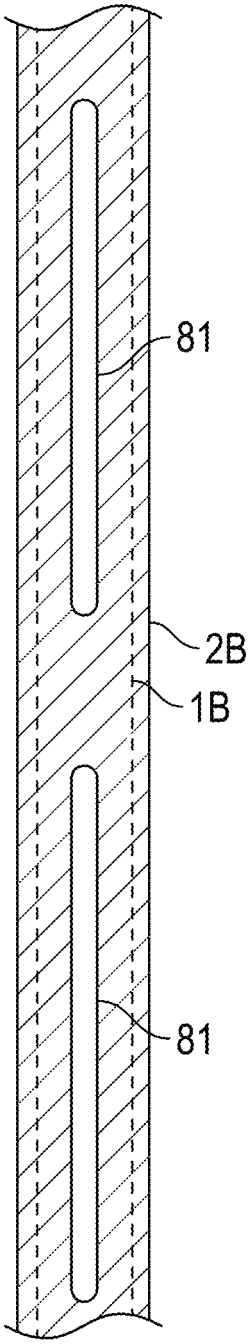
FIG. 10 illustrates a portion of an example guide component configured to move up and down inside the flagstick to move a grabbing component toward a golf ball in a golf hole.
Figure 11:
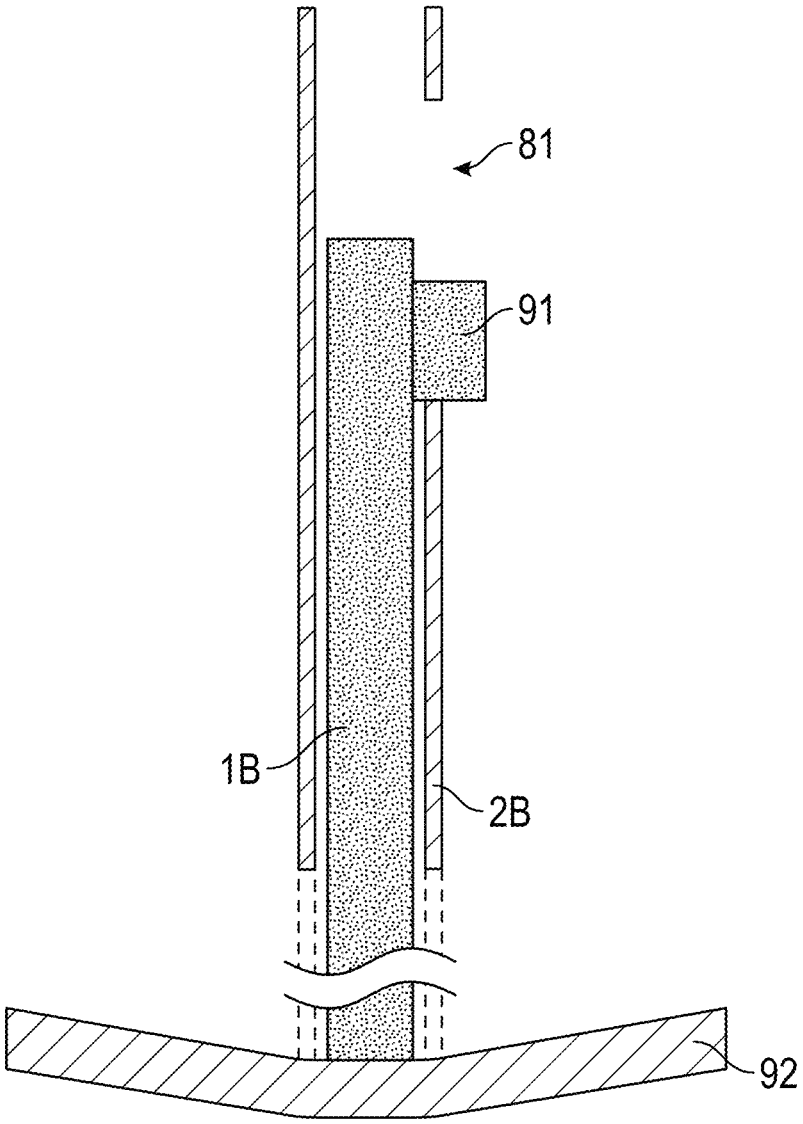
FIG. 11 illustrates an example of a guide component with a handle that extends through a slot of the flagstick.
Figure 12:
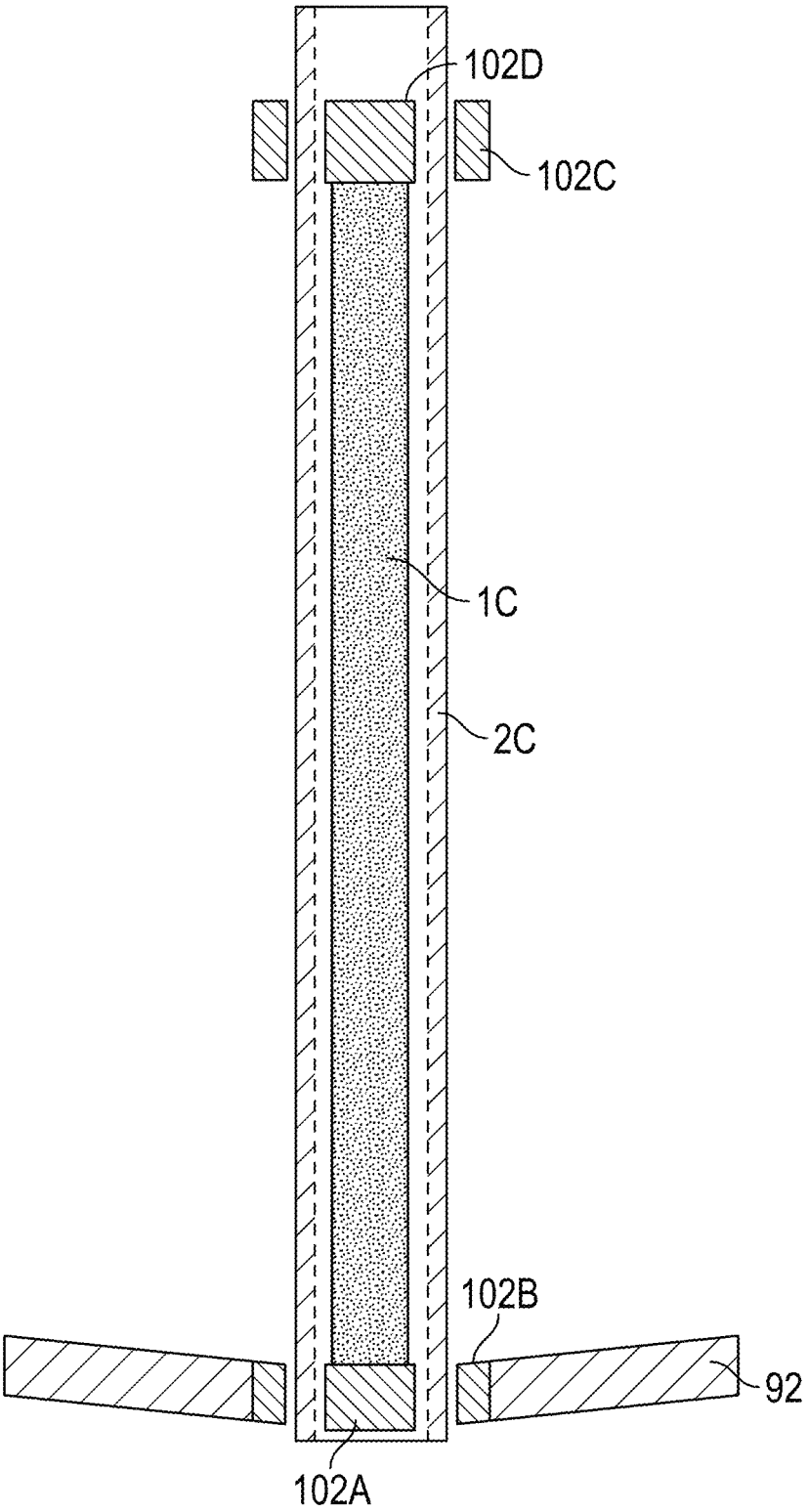
FIG. 12 illustrates another embodiment of an internal guide component and external flagstick.

FIGS. 10-12 illustrate embodiments where a portion of a guide component 1B is internal to the flagstick 2B. FIG. 10 illustrates a portion of a guide component 1B configured to move up and down inside the flagstick 2B to move a grabbing component 3 (not shown) toward a golf ball 8 in a golf hole 5. Any of the grabbing components discussed herein may be used in conjunction with the internal guide component 1B, such as illustrated in FIG. 10. In this embodiment, the flagstick 2B includes one or more slots 81 through which a portion of the guide component 1B may extend for movement by a golfer. For example, with reference to FIG. 11, the guide component 1B with a handle 91 that extends through a slot 81 of the flagstick 2B. FIG. 11 also includes a ball-elevating disk guide 92 that rests at the bottom of the golf hole 5 until a golf ball 8 enters the golf hole 5. At that time, the handle 91 may be raised by the golfer to cause the guide component 1B to slide within the flagstick 2B, raising the guide 92, and the ball that is supported thereon, out of the golf hole 5. When the handle 91 is released, the guide component 1B slides back down the flagstick 2B until the guide 92 again rest on the bottom of the golf hole 5, out of the view of the golfer. In some embodiments, the guide 92 may be 2" or less in diameter to conform with the USGA Rules of Golf. It may expand in diameter when elevated using an aperture mechanism keep the ball from sliding off when elevated above the hole.

In other embodiments, an internal guide component 1 similar to those shown in FIGS. 10-12 may be attached to a grabbing component 3 that grabs the golf ball 8 when lowered onto the golf ball 8, and then is returned to a raised position by a manual and/or spring loaded movement component 4, for example.

FIG. 12 illustrates another embodiment with an internal guide component 1C and external flagstick 2C. In this example, the inner guide component 1C is composed of or is attached to a magnet or ferromagnetic material 102D, or metal that can be attracted by a magnet. Similarly, the guide 92 includes a magnet or ferromagnetic material 102B that is attracted to material 102A of the internal guide component 1C when lowered into the golf hole 5, such that the guide 92 may be lifted out of the golf hole 5 by moving the handle 102C upward. In some embodiments, the handle 102C is a circumferential collar or handle that is external to the flagstick 2C and can be magnetically linked to the guide component 1C via attraction to the magnet 102D. Accordingly, the golfer can control flagstick 2C and the guide 92 (and/or any of the grabbing components 3 discussed herein) by sliding the guide component 1C up or down within the flagstick 2C via movement of the handle 102C.

As noted above, in some embodiments the ball removers (or "ball-grabbing devices") are designed to double as hole position indicators and thus conform to the USGA Rules of Golf even if they are greater than about 2 cm in diameter. For example, the ball removers may be colored to indicate the hole position as being near the front, middle, or back of the putting green. Various designs for the ball removes may be employed, such that the diameter is less than the diameter of a hole insert device that is placed into the golf hole 5. For example, given a golf hole diameter of about 4.25 inches, the outer diameter of the hole insert device may be about 4.24 inches and the inner diameter of the hole insert device may be about 4.20 inches. In this event, grabbing component 3 may be about 4.15 inches or less in diameter.

What is claimed is:

1. A golf ball remover comprising:

a longitudinal guide component having a longitudinal aperture sized for placement onto a golf flagstick positioned in a golf hole, wherein the longitudinal guide component is moveable along at least a portion of a length of the golf flagstick;

a movement component attached to the guide component; and a grabbing component at a distal end of the guide component, located at least 3 inches above the putting surface, the grabbing component configured to removably attach to a golf ball positioned in the golf hole;

wherein application of an external downward force on the guide component moves the guide component and grabbing component downward towards the golf hole to attach to the golf ball or to support the golf ball below the ball's equator and, in response to release of the external downward force an upward force from the movement component moves the guide component and grabbing component upward away from the golf hole.

2. The golf ball remover of claim 1, wherein downward movement of the guide component increases an elastic potential energy stored by the movement component, and wherein the upward force results from release of the elastic potential energy.

3. The golf ball remover of claim 1, wherein the movement component comprises one or more springs that compress as the guide component is moved downward.

4. The golf ball remover of claim 1, wherein the movement component comprises one or more elastic members that stretch as the guide component is moved downward.

5. The golf ball remover of claim 1, wherein the grabbing component is sized to fit within the golf hole without touching inner edges around a circumference of the golf hole.

6. The golf ball remover of claim 1, wherein the grabbing component comprises at least a first and second flexible members configured to flex away from one another as the flexible members engage a top portion of the golf ball positioned in the golf hole so that the first flexible member is on a first side of the golf ball and the second flexible member is on an opposite second side of the golf ball, wherein the flexible members are further configured to flex towards one another as the flexible members are moved below mid-height of the golf ball such that a distance between lower portions of the flexible members is less than a diameter of the golf ball and movement of the grabbing component upward causes the golf ball to be lifted upward atop the lower portions of the flexible members.

7. The golf ball remover of claim 6, wherein the first and second flexible members comprise a wire.

8. The golf ball remover of claim 6, wherein the first and second flexible members comprise plastic.

9. The golf ball remover of claim 6, wherein the grabbing component comprises three or more flexible members.

10. The golf ball remover of claim 6, wherein the grabbing component comprises a central cylinder that surrounds the guide component and at least a first and second flexible member extending outward from the cylinder to define a gap sized to engage the golf ball when the external force pushes the guide component such that the flexible members engage with the golf ball.

11. The golf ball remover of claim 10, wherein the flexible member comprises four flexible members that define four gaps therebetween sized to engage the golf ball.

12. The golf ball remover of claim 1, wherein the grabbing component comprises a central cylinder that surrounds the flagstick and an outer cylinder that defines a radial gap extending from the central cylinder to an inner circumference of the outer cylinder of less than a diameter of the golf ball.

13. The golf ball remover of claim 12, wherein the grabbing component is configured to engage the golf ball between the central cylinder and the outer cylinder as the external force moves the guide component and the grabbing component towards the golf hole.

14. The golf ball remover of claim 12, wherein the gap extends radially about the central cylinder.

15. The golf ball remover of claim 12, wherein the gap is about 0.5 mm to 2 mm less than the diameter of the golf ball.

16. The golf ball remover of claim 12, wherein the grabbing component comprises a flexible material.

17. The golf ball remover of claim 12, wherein the grabbing component comprises one or more support structures coupling the outer cylinder to the inner cylinder to maintain a constant radial gap about the central cylinder.

18. The golf ball remover of claim 17, wherein each of the one or more support structures defines a hemispherical space below the support structure.

19. The golf ball remover of claim 17, wherein the one or more support structures is substantially hemispherical with one or more cutouts parallel to a longitudinal axis of the flagstick extending therethrough.

* * * * *